US006486795B1

(12) United States Patent
Sobel et al.

(10) Patent No.: US 6,486,795 B1
(45) Date of Patent: Nov. 26, 2002

(54) UNIVERSAL TRANSMITTER

(75) Inventors: Raymond L. Sobel, Oceanside; Farid Khadem, San Diego; Jerry Piekos, Ramona, all of CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 09/126,556

(22) Filed: Jul. 31, 1998

(51) Int. Cl.[7] ..... G08C 19/00

(52) U.S. Cl. ..... 340/825.72; 340/825.69; 340/825.52; 340/825.22; 340/5.2; 340/5.23; 343/853; 343/895; 455/275; 455/277.1

(58) Field of Search ..... 340/825.72, 825.69, 340/825.52, 825.22, 825.31, 5.2, 5.23; 343/895, 853; 455/275, 277.1

(56) References Cited

U.S. PATENT DOCUMENTS 3,906,348 A * 9/1975 Willmott ..... 340/825.69
4,529,980 A * 7/1985 Liotine et al. ..... 340/825.52
5,054,114 A 10/1991 Erickson et al.
5,564,101 A 10/1996 Eisfeld et al.
5,661,804 A 8/1997 Dykema et al.
5,686,903 A * 11/1997 Duckworth et al. ... 340/825.22
5,896,113 A * 4/1999 O'Neill, Jr. ..... 343/895
6,081,203 A * 6/2000 Fitzgibbon ..... 340/825.72

* cited by examiner

*Primary Examiner*—Brian Zimmerman
*Assistant Examiner*—Yves Dalencourt
(74) *Attorney, Agent, or Firm*—Fitch, Even, Tabin & Flannery

(57) ABSTRACT

A universal remote control radio frequency transmitter for use with garage door operators, gate operators and other barrier movement operators is programmable through the use of external switches. The same switches are used after programming for causing the transmitter to transmit an RF signal at about the selected frequency and with a code corresponding to the programmed code. A plurality of RF frequencies are generated by a single RF circuit and a single loop antenna. The selected frequency is determined by digital controller logic and PIN diode shorting in and out selected reactive elements in the RF circuit.

10 Claims, 9 Drawing Sheets

Fig. 2
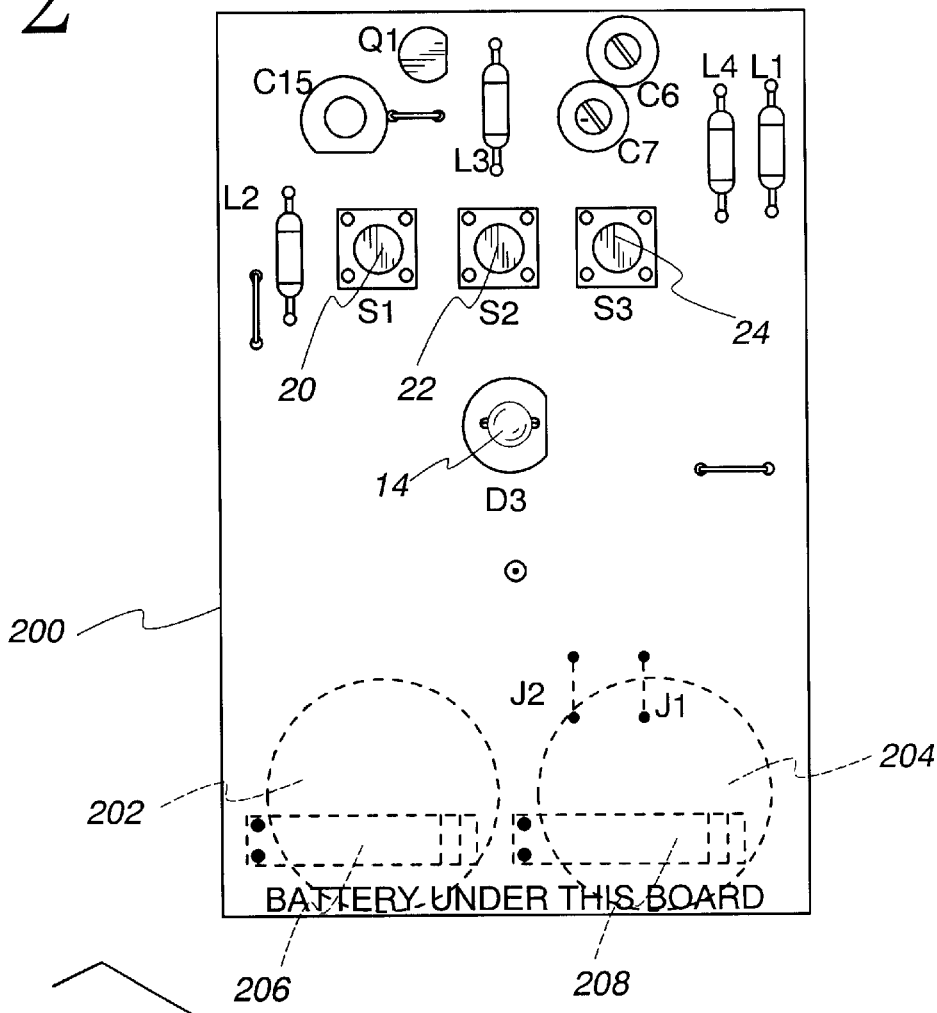
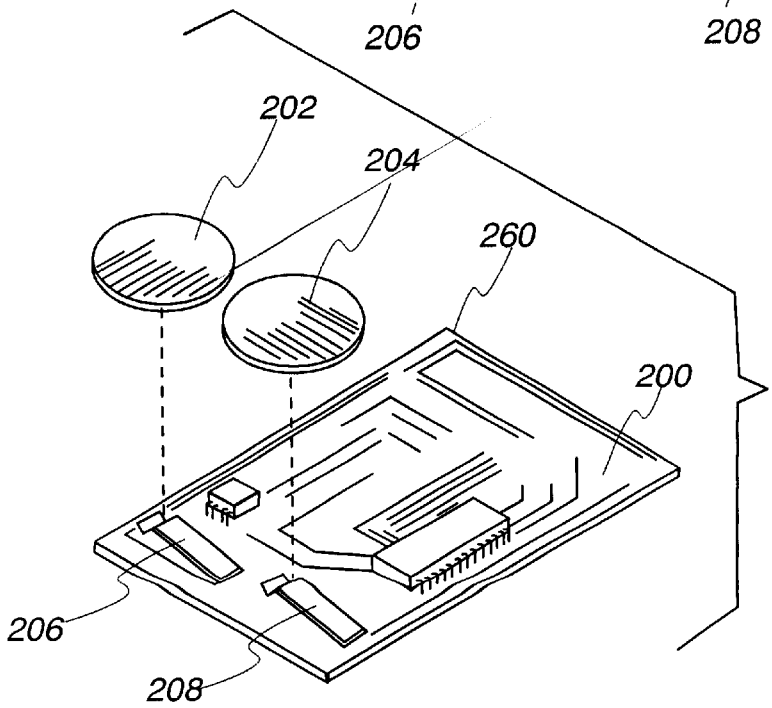
Fig. 3

TOP LEVEL TUNING FLOW DIAGRAM

UNIVERSAL TRANSMITTER

BACKGROUND OF THE INVENTION

This invention relates to a universal transmitter which can operate a garage door operator, a gate operator and other movable barrier operators, and more particularly to a universal transmitter which can select among a plurality of different channels and, using a single antenna loop and a single radio frequency (RF) circuit, transmit on the selected channel.

Most manufacturer-supplied transmitters designed for garage door or gate applications are single function, single frequency devices with a preset carrier frequency and use either a switch-selectable code or a preset factory code. Switch-selectable codes are set by the user setting a plurality of switches on the transmitter and the receiver units. Factory-set codes are input into the receiver by causing a microcontroller or other processor such as a microprocessor, gate array or the like, within the receiver to perform a learn function. The receiver enters the learn mode, then the user activates the transmitter, which transmits a signal representing the factory programmed code stored in it. The most recent transmitters employ rolling code or other code encryption.

Each manufacturer has developed its own separate modulation format and selected its own carrier frequency. Recently, some O.E.M.'s and aftermarket manufacturers have developed transmitters which permit the generation of multiple formats and frequencies within a single transmitter.

The aftermarket for garage door, gate and other movable barrier operator remote transmitters is brisk. As manufacturers improve their products by offering greater functionality, the cost of providing replacement parts for older model units increases. Generally, receivers have a longer working life than remote transmitters. A goal among aftermarket providers is to furnish a single, universal transmitter which can be programmed to be used in a multitude of systems from different manufacturers.

The difficulty of designing a universal transmitter which can operate at multiple frequencies for multiple code types, while keeping manufacturing costs down is the aftermarket supplier's greatest challenge.

U.S. Pat. No. 5,564,101 to Eisfeld et al. discloses a system having a plurality of complete transmitter circuits for generating a plurality of difference RF carrier frequencies to operate a plurality of different receivers. The transmitter includes two sets of mechanical switches or DIP switches by which the user sets the transmitter code and the carrier frequency. A separate oscillator and an antenna is provided for each user-selected RF carrier frequency.

U.S. Pat. No. 5,661,804 to Dykema et al. discloses a learning transmitter which can operate a plurality of different receivers which employ a rolling or encrypted code. No user input is required to learn the code and frequency, other than activating the transmitter to be copied. A single RF circuit and dynamically tunable antenna is provided for transmitting the learned code. The single RF circuit employs a phase locked loop frequency synthesizer and separate control logic for outputting the learned frequency and code.

While both of these system are capable of operating a plurality of receivers, each is complex and expensive. There is a need for an inexpensive, simple, universal transmitter capable of operating a multitude of different receivers at different frequencies. There is a need for a universal transmitter which uses a single transmitter circuit, using simple components, for transmitting a plurality of different carrier frequencies.

SUMMARY OF THE INVENTION

A radio frequency transmitter according to the invention provides a unique combination of inexpensive and simple circuits. It is compatible with a large number of garage door, gate and barrier operators manufactured by different manufacturers. The radio frequency transmitter can be programmed to activate a plurality of movable barrier operator receivers, each receiver receiving a particular carrier frequency modulated according to a particular modulation scheme.

The RF transmitter includes a single transmitter circuit for transmitting a signal at a plurality of different carrier frequencies according to a plurality of different modulation codes. The single transmitter circuit includes a transmit oscillator, a tuning circuit comprising a plurality of discrete reactive components, a radiating element having a variable length, and a control circuit coupled to the tuning circuit, the transmit oscillator and the variable radiating element. The user inputs a desired carrier frequency and a desired modulation code through a plurality of switches. These values are stored in a programmable controller. A particular carrier frequency and code can be assigned to each switch. In a preferred embodiment, the transmitter includes three user switches for operating up to three different barrier operators.

A programmable controller is coupled to the transmitter circuit for operating the transmitter circuit to cause the transmitter circuit to be modulated with signals generated by the programmable controller from the stored user-selected carrier frequency and the stored user-selected modulation code. Specifically, the programmable controller provides the logic to select the particular reactive elements in the tuning circuit, transmit oscillator and to vary the electrical length of the radiating element. The variable length radiating element is operable for radio frequency transmission of the signals generated by the programmable controller.

Preferably the programmable controller provides logic control to PIN diode switches for shorting in or out selected reactive elements and for varying the electrical length of the loop antenna element. Specifically, the PIN diodes are used to short out various capacitors in the tuning circuit and the transmit oscillator circuit. When not selected, preferably the PIN diodes are reverse-biased. While in the off state, the PIN diodes have a high impedance and low capacitance. This minimizes stray parasitic transmissions.

A single transmitter circuit is used for all RF frequencies. Two or more of the external switches are used for programming in the manufacturer's carrier frequency and to set the transmitter's code. Preferably the variable length radiating element is a loop formed as a trace on a printed circuit board.

In a single RF circuit switching to obtain multiple carrier frequencies is relatively straightforward. It may be difficult, however, to eliminate harmonics that are prohibited by FCC standards. Elimination of harmonics is achieved through positioning of the reactive elements of the transmit oscillator circuit, the tuning elements and the radiating element located on the printed circuit board. PIN diodes are used to short across capacitors instead of switching in and out of the circuit. This has the advantage of eliminating interaction between the components.

Lead lengths between the components in the transmit oscillator and tuning circuits are made as short as possible to minimize changes from board to board during manufacturing. Capacitive elements are positioned on opposite sides of the printed circuit board to cut down on parasitic harmonic radiation. Selected elements in the transmit oscillate circuit, as well as the loop antenna, form part of the radiating element.

BRIEF DESCRIPTION OF THE DRAWINGS

FIG. 2 is a plan view of a top of a printed circuit board layout for the transmitter of FIG. 1;

FIG. 3 is a partially exploded view showing the location of a pair of batteries in a case for a transmitter according to the invention;

DETAILED DESCRIPTION OF THE PREFERRED EMBODIMENT

Figure 1:
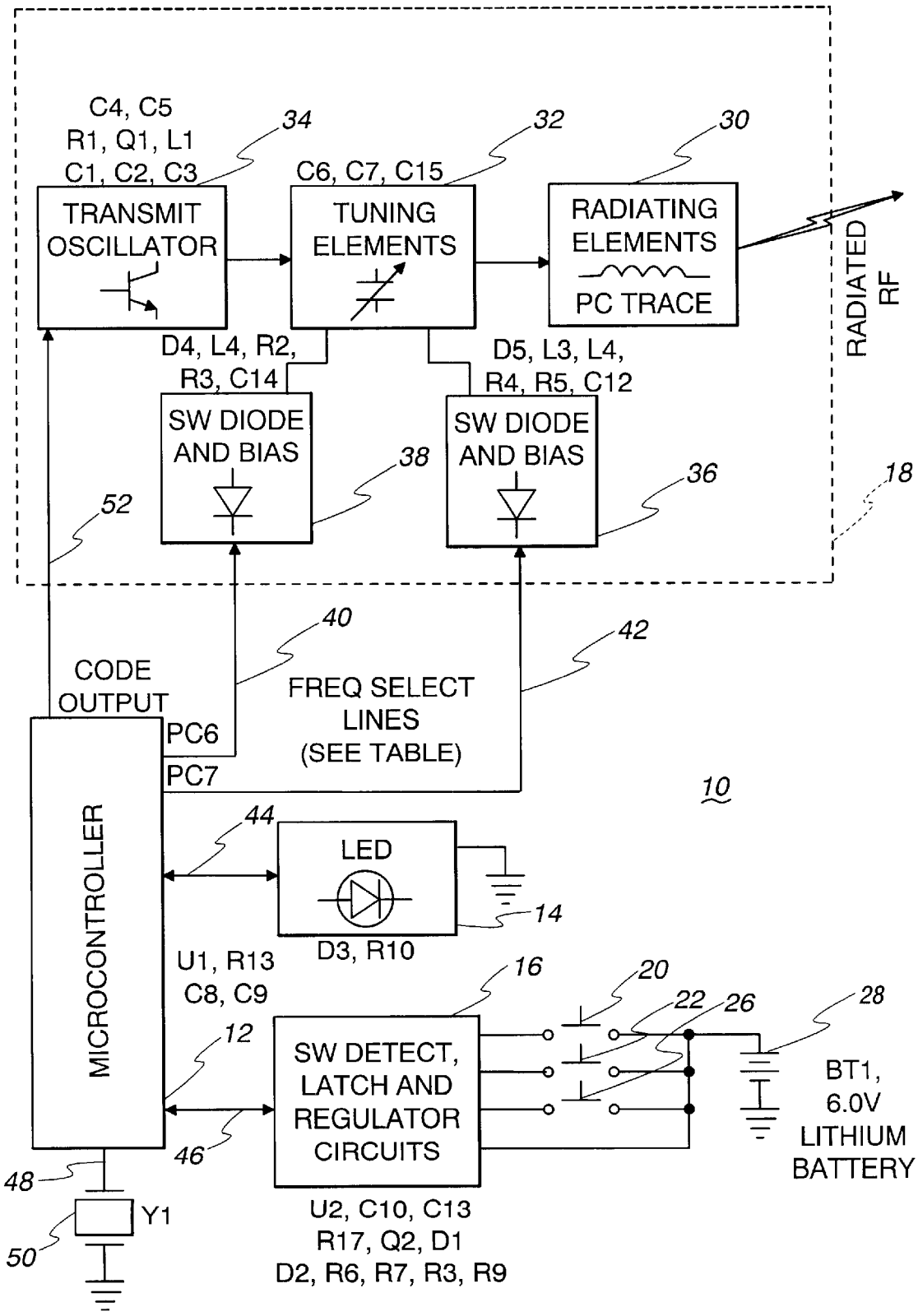
FIG. 1 is a block diagram of the circuit for a transmitter embodying the present invention.

Referring now to the drawings, and especially to FIG. 1, a universal radio frequency transmitter embodying the present invention is shown therein and generally indicated by numeral 10. Universal transmitter 10 includes microcontroller 12, LED circuit 14, switch detect, regulator and latch circuit 16, and RF circuit 18. RF circuit 18 includes transmit oscillator 34, tuning elements 32, radiating element 30 and switching circuits 36 and 38.

Transmit oscillator 34 generates the radio frequency (RF) energy which conveys the transmitter code information to the receiver. Transistor Q1 is the active transistor element of the oscillator 34. Fixed capacitors C1–C5, tuning elements 32, comprising capacitors C6, C7, C15 and a radiating element 30, comprising a PC trace inductive radiating element comprise the frequency-determining parts of the transmitter circuit. The elements are configured as a pi-network feedback circuit. Switching circuit 36 includes PIN diode D5, inductors L3 and L4, resistors R4 and R5 and capacitor C12; switching circuit 38 includes PIN diode D4, inductor L2, resistors R2 and R3 and capacitor C14. Switching circuits 36 and 38 select the particular reactive elements in RF circuit 18 to select the RF transmission frequency.

Microcontroller 12 controls the frequency to be transmitted by the RF circuit 18. The microcontroller 12 also controls the code. Code stored in the memory of microcontroller 12 is provided to the transmit oscillator 34 via a line 52 from the microcontroller 12. Frequency output stored in the memory of microcontroller 12 is determined by frequency select lines 40 and 42. The microprocessor 12 sends enable or disable signals to switching modules 36 and 38. The switching modules 36 and 38 selectively add or take out various reactive elements in the tuning circuit 32, transmit oscillator circuit 34 and selectively vary the electrical length of radiating element 30 allowing the selection of a transmit frequency. Preferably, the reactive elements are selected to cause the transmitter to transmit at 300 MHz., 310 MHz, and 390 MHz., three of the most popular frequencies used by garage door operator manufacturers.

The microcontroller 12 enables the LED circuit 14 via a signal along a line 44. The LED circuit 14 activates a red light emitting diode to provide visual feedback to the user during the various programming functions (described below) and when the transmitter 10 is sending an RF signal to a receiver.

Microcontroller 12 enables the switch detect, latch and regulator circuit 16 along line 46. The regulator circuit 16 allows the microcontroller 12 to remain in regulation for the life of the two cell 6 volt lithium battery source 28. The regulator circuit 16 also forms part of a latch circuit 16 that keeps the power on when required (i.e., during transmission). The pushbutton switches 20, 22, and 24 perform programming and transmit select functions. With three switches, the transmitter is capable of up to three different channel operation.

Figure 4:
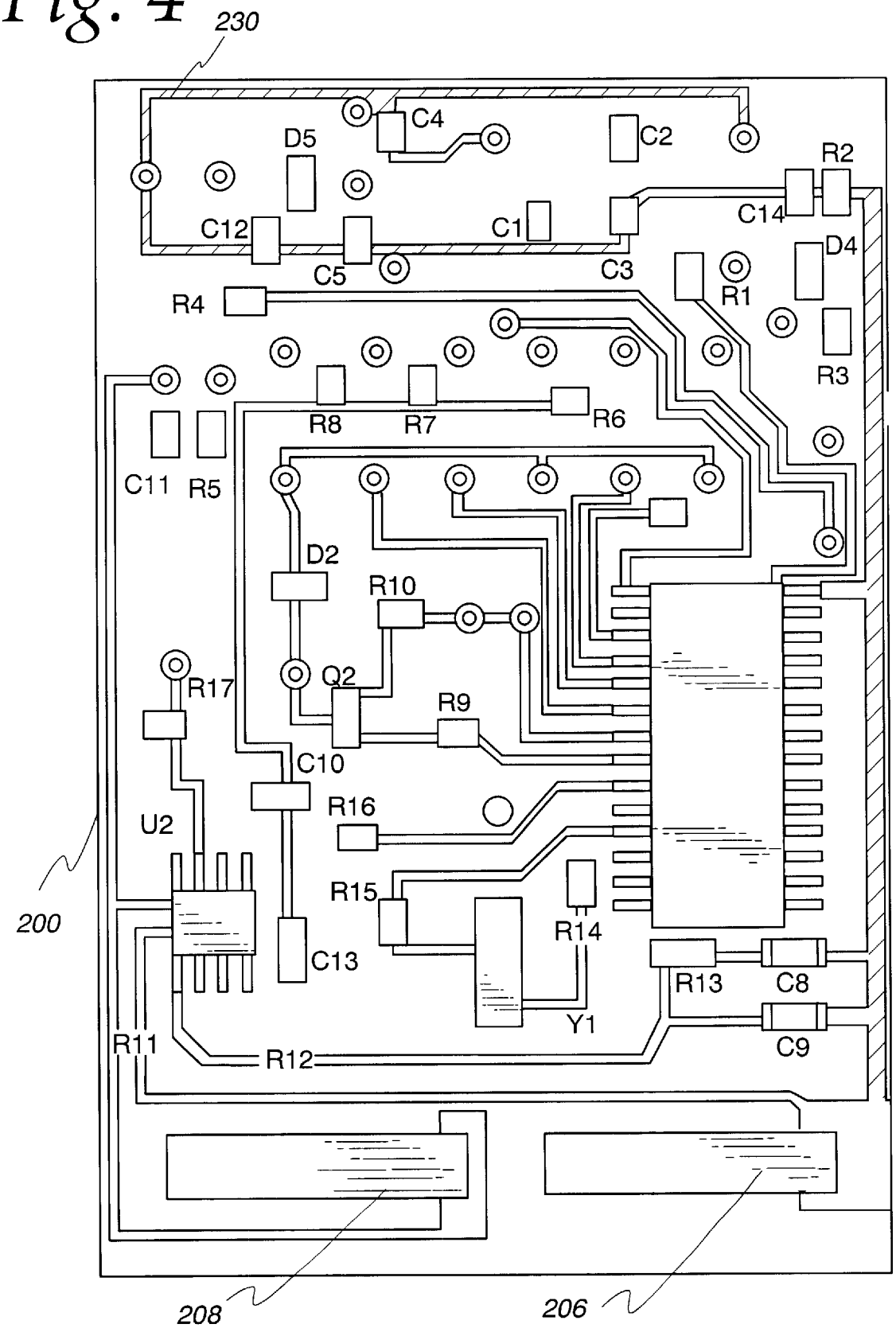
FIG. 4 is a plan view of the bottom of the printed circuit board of FIG. 2.

Location of the reactive elements and the variable length PC trace forming the radiating element is an important aspect of the invention. Lead lengths between reactive elements were minimized as much as possible to avoid parasitical harmonic radiation and variation between boards during manufacture. Capacitors were placed physically on opposite sides of the board. Because of the component design of the transmit oscillate and tuning circuits, radiation from reactive elements becomes an important consideration in designing the radiating element. A preferred physical layout of components and the pc trace radiating element is shown in FIGS. 2 and 4. Components for this preferred embodiment are set forth in Table 1 below.

TABLE 1

| Ref. Desc. | Description | Part No. |
|---|---|---|
| R9, R13, R15, R16, R17 | 100k, 1/10w, 5% SMT | CR0805-1003FTR |
| R6, R7, R8 | 10k, 1/10w, 5%, SMT | CRO805-1002FTR |
| R14 | 1M, 1/10w, 5% SMT | CRO805-1004FTR |
| R10 | 3.3k, 1/10w, 5% | CRO805-3301JTR |
| R2, R3 | 4.7k, 1/10w, 5% | CR0805-4701JTR |
| R1 | 56k, 1/10w, 5% | CRO805-5602JTR |
| R4 R5 | 1k, 1/10w, 5% | CRO805-1101JTR |
| C15 | CAP, VAR, 2.8–10 pf | GKG10011/SG1002ND |
| C8, C9, C10 | CAP, .1 μf SMT | GRM426X75104J050RL |
| C6, C7 | CAP, VAR, 1.7–3 pf | GRG3R021/RS03A |
| C1 | CAP, 1.5 pf | GRM40C0G1R5C020RL |
| C13 | CAP, 2.2 μf | F931A225KAA **** |
| C2, C3 | CAP, 3.9 pf | GRM40C0G3R9C050BD |
| C11, C12, C14 | CAP, 470 pf | MA0805CG-471J500 |
| C4 | CAP, 8.2 pf | MA0805CG08R2J500 |
| C5 | CAP, 3.3 pf | MA0805CG-3R3J500 |
| L1, L2, L3, L4 | Choke, 1UH | 78F1R0K/M7813-ND |
| Y1 | 4 MHz Resonator SMT | CSTCS4, 00MG-TC |
| D3 | LED | HLMP1700QT-ND |
| Q1 | XSTR, MPS-H10 | MPS-H10/MPSH10-ND |
| D1, D2 | HS Dode SMT | MMBD4148 |
| Q2 | NPN, SMT | MMBD3904LTI (MOT) |
| U2 | Voltage reg | LK115D47 |
| D4, D5 | PIN Diode | MMBV3401LT1 (MOT) |
| SW1 | SW, TACT, 160GF | PTS645SL43 |
| J1, J2, J3, J4, J5 | Jumper Wire | LEADS FROM 300–001 |
| U1 | Processor | 68HC805P18 |

A preferred layout of the transmitter which transmits at 300 MHz., 310 MHz. and 390 MHz. is shown in FIGS. 2, 3 and 3. Two three volt lithium batteries 202 and 204 are disposed at one end of a housing 260. Terminals 206 and 208, mounted to printed circuit board 200 form contacts with batteries 202 and 204 when the unit is assembled. Location of the batteries has been chosen to minimize interference with the radiating elements of the transmitter. Capacitor C15 is advantageously located on top of capacitor C14. Capacitors C6 and C7 are advantageously located on top of capacitors C4 and C5. PC traces 230 comprises the u-shaped loop section on the upper part of the board 200 as shown on FIG. 4. During operation of the transmitter, when certain frequencies are selected, portions of the PC traces 230 are selectively added or deleted from the radiating element 30.

Figure 5:
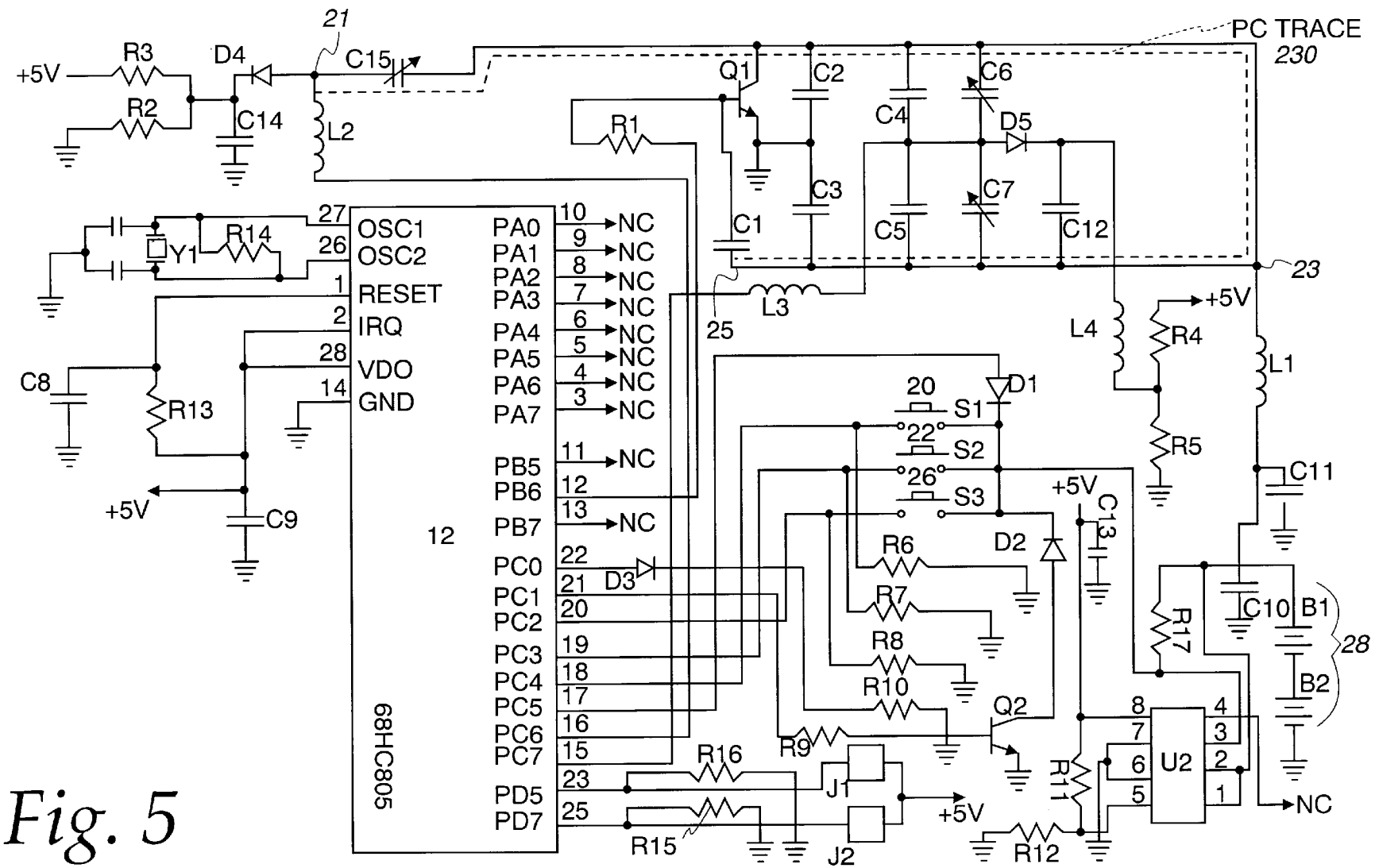
FIG. 5 is a schematic of an electronic circuit for a transmitter shown in FIG. 1.

Referring to FIG. 5, microcontroller 12 is preferably a 68HC805. Choke inductor L1 provides RF isolation and battery power to the transmit oscillator circuit 34 (comprising resistor R1, transistor Q1, and capacitors C1, C2, C3, C4 and C5. Resistor R1 provides base current to Q1 to turn the transmit oscillator 34 on and off in accordance with the code output stored in the microcontroller 12. Code output is provided from microcontroller 12 via pin PB6.

Microcontroller 12 sends frequency select signals from pins PC6 and PC7. The state of pin PC6 controls PIN diode D4; the state of pin PC7 controls PIN diode D5. Inductors L2, L3 and L4 provide RF isolation between the logic (microcontroller inputs) and the RF transmit circuits (32 and 34). Resistors R2, R3, R4 and R5 provide forward and reverse biasing of the PIN diodes D4 and D5.

PIN diodes D4 and D5 short out the tuning (variable) capacitors, C6, C7 and C15 depending on the desired transmit frequency in accordance with the Frequency Select Logic Table 2. Additionally, various of the fixed capacitors C1 through C5 and sections of the printed circuit (PC) loop 230 are also shorted out depending on the desired frequency.

TABLE 2

Frequency Select Logic

| PC6 | PC7 | Frequency |
|---|---|---|
| 0 | 0 | 390 MHz. |
| 0 | 1 | 310 MHz. |
| 1 | 1 | 300 MHz. |

When PC6 is high, D4 is forward-biased and C15 is RF grounded through C14 and contributes reactance to the circuit. When PC6 is low, D4 is reverse-biased and C15 is floating and not contributing to the RF circuit.

When PC7 is high, D5 is forward-biased, it shunts the node at capacitors C6 and C7 through C12 effectively changing the affective radiating area of the PC trace loop antenna element. When PC7 is low, D5 is reverse-biased and C12 floats and does not contribute to the RF circuit. C12 and C14 are DC blocking capacitors that provide an RF short when D4 and D5 are forward-biased.

The PC loop trace radiating element, shown by dashed line 230 on FIG. 5, is formed by the leads shown beginning at node 21, at the connection of C15, D4 and L2, running to node 23, at the connection of L1 and C12, running to the node 25 between capacitors C1 and C3.

The microcontroller 12 is an 8-bit microcontroller which, in addition to program memory and RAM also includes a small amount of EEPROM. This combination allows code that is field programmable and non-volatile. The microcontroller 12 timing is based on an on-board oscillator with an external 4 MHz ceramic resonator, Y1, at pins OSC1 and OSC2 of the microcontroller 12. Resistor R13 and capacitor C8 form the reset timing circuit for microcontroller 12 at pins reset and IRQ.

Switch detect, latch and regulator circuit 16 includes regulator U2, capacitor C10, C11, C13, diodes D1, D2, transistor Q2 and resistors R6, R7, R8, R9 and R17. Regulator U2 is a low-voltage drop type operating at 4.75 volts. This allows the microcontroller 12 to receive voltage regulated power regulation for the life of the two-cell 6 volt lithium battery source 28.

Switch input from external switches S1 20, S2 22 and S3 26 is provided to microcontroller 12 at pins PC4, PC5 and PC6. When one of 20, 22 and/or 26 is closed, D1 draws power from bias resistor R7. Resistors R6, R7, R8 limit the current through switches 20, 22, 26. Resistors R11, R12 provide power to voltage regulator U2. Capacitors C10, C11, C13 provide DC blocking of RF. Microcontroller 12 controls transistor Q2 by providing a signal from pin PC1 to its base. The pushbutton switches S1–S3 (20, 22 and 26) perform programming and transmit select functions. With three switches, the transmitter is capable of up to three different channel operations. The red LED D3 is activated by pin PC0 of microcontroller 12 and the associated current limit resistor R10 allows visual feedback to the user for transmit indication and programming aid.

To assist in manufacturing and test of the universal transmitter, jumpers J1 and J2 are provided. Jumpers J1 and J2 provide input to microprocessor 12 at pins PD5 and PD6. When activated, microprocessor 12 outputs three pre-selected code formats and frequencies (stored in memory). As the units are fine tuned and adjusted for frequency, the jumpers J1 and J2 are cut away, which then enables buttons S1, S2 and S3 to program in frequency and code format. Using jumpers J1 and J2 to test the transmitter saves manufacturing and assembly time, including the time to program each transmitter to test each of the pre-set frequencies.

Table 2 shows the frequency select logic states for three pre-selected frequencies, 300, 310 and 390 MHz. These frequencies are the most common among existing garage door operators. Other freauencies may be selected by appropriate modification of the tuning circuit components. The transmitter of the invention can be programmed to operate a plurality of different garage door (or other apparatus) receivers, one for each switch button. The preferred number of receivers is three, which may operate at the preferred frequencies of 300 MHz, 310 MHz and 390 MHz. To operate the universal transmitter 10, the user must program in both a code frequency and a transmitter code.

Programming the Transmitter

Programming the universal transmitter according to the invention will be described with respect to a three switch transmitter, i.e., one which can operate up to three receivers. To assist in programming the transmitter for operation, a table of known manufacturer's along with their particular frequency of transmission is stored in memory of the microcontroller 12. For example, the transmitter may be programmed to operate Stanley, Multi-Code, Linear, Sears, Chamberlain, Lift-Master, Genie (with nine code switches) and Genie (with twelve code switches). A number is assigned to each manufacturer, which number is used by the microcontroller 12 to determine which frequency to use for transmission. For example, Stanley is assigned 1, Multi-Code is assigned 2, Linear is assigned 3, Sears, Chamberlain and Lift-Master are assigned 4, Genie receives with nine code switches is assigned 5 and Genie receives with twelve code switches are assigned 6.

The universal transmitter must be programmed with both a frequency and a code before it will operate. To program the universal transmitter with a code, the user must determine the code of the transmitter of his present system. For systems with code switches, the user simply records the position of each switch. If the user's present system employs a learning receiver, i.e., a receiver which learns the factory set code stored in the transmitter, the user can select any code for the universal transmitter.

The external switches, 20, 22 and 26 are arbitrarily assigned designators "1," "2," and "3." These designators are used to assign codes for three separate receivers. Button 1 may be used to operate a first receiver, and so on. Buttons 1, 2 and 3 also have programming functions. Button 1 is used to turn the universal transmitter on; button 3 is used to turn the universal transmitter off. Button 1 is used to increment, button 2 is used for 0, and button 3 is used to decrement.

To program the unit, the user first determines how many receivers he would like to program and which receiver to assign to which button. If the user wishes to program button 1 to operate his Chamberlain receiver, the user presses buttons 1 and 3 simultaneously until the red LED starts to blink. When the red light starts the blink, the user releases both buttons. When the red light stops blinking, the unit is ready to start programming. Since a Chamberlain unit has been selected, the user presses button 1 four times. The red LED will blink the number of times button 1 was pressed, or 4.

Next the input code is programmed. The Chamberlain unit has a nine switch code, where each switch has three positions: +, 0 and −. For example, if the code is +++0 0 0−−−, the user would press button 1 three times, button 2 three times and button 3 three times. After inputting the code, the red LED will blink the number for the manufacturer to signal the programming has been successful. In this example, the LED would blink 4 times. As soon as the blinking stops, the transmitter 10 is ready to operate the receiver. Pressing button 1 will cause the transmitter to send a frequency and code to operate the Chamberlain receiver. Programming buttons 2 and 3 to operate other receivers is similar.

Figure 6A:
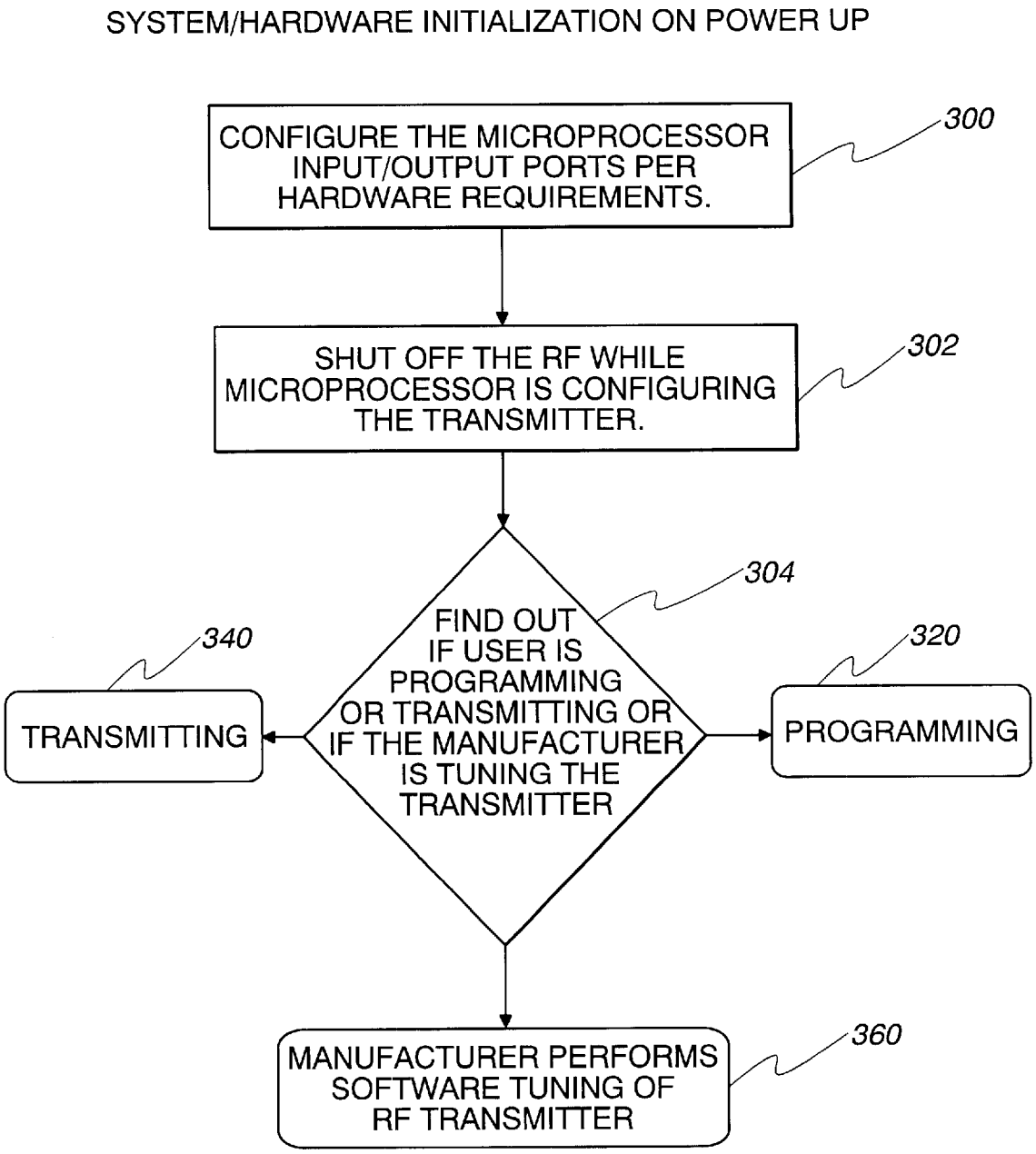
FIGS. 6A–6E are flow charts showing the top level operation of some of the software routines operating a transmitter according to the invention.

When the transmitter 10 is first powered up by the user pressing switch 1, the On button, microcontroller 12 executes a System/Hardware Initialization On Power Up routine shown in FIG. 6A. At block 300, the microprocessor 12 configures its input/output ports. At block 302, the RF circuit 18 is disabled while the microprocessor 12 configures the transmitter for operation. At block 304, microcontroller 12 checks if the user is programming the transmitter, transmitting a code or if the manufacturer is testing the transmitter. If transmitting, the routine branches to block 340. If programming, the routine branches to block 320. If the manufacturer is performing a test, the routine branches to block 360.

Figure 6B:
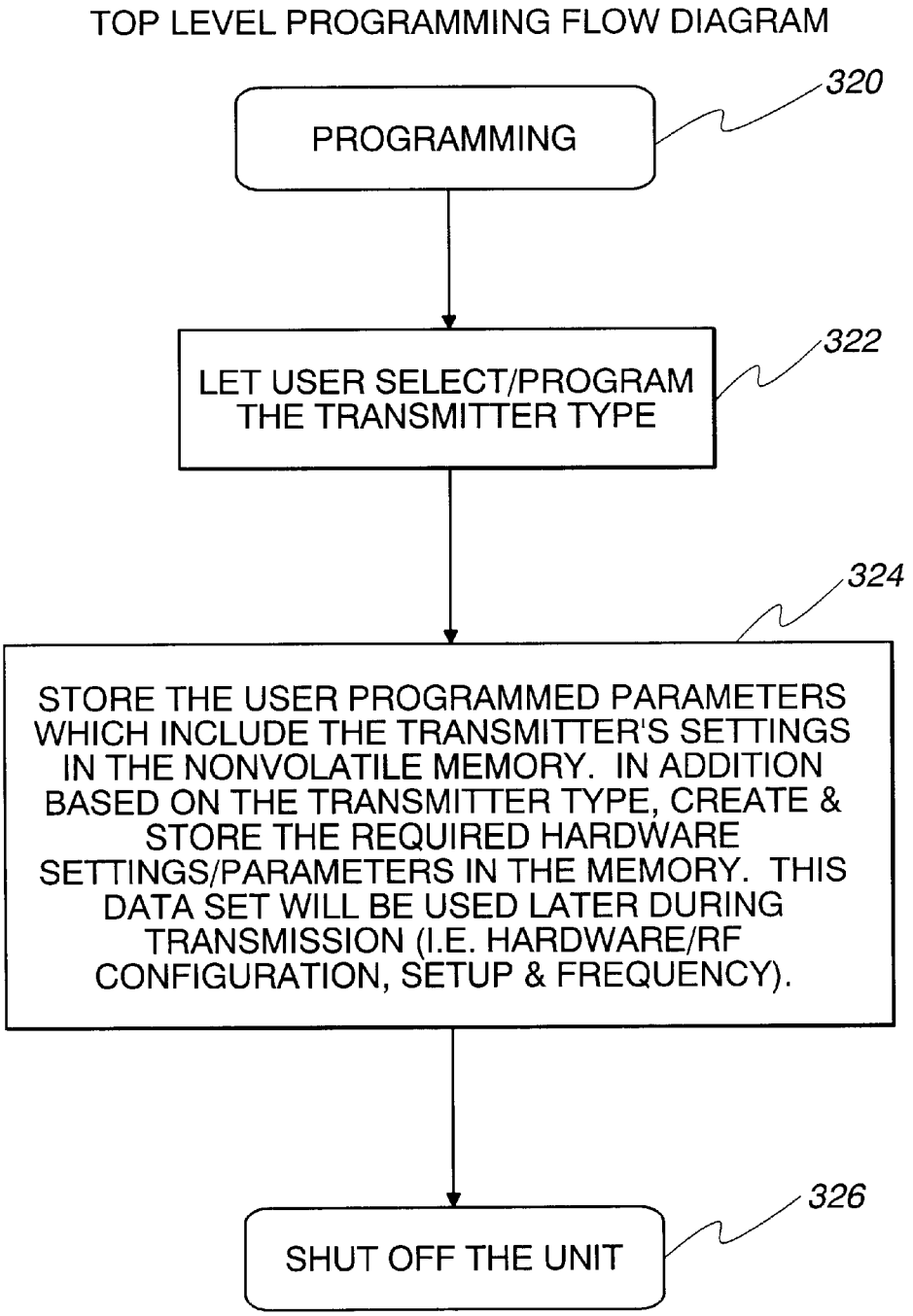

If the user is programming the transmitter, further elements of the programming block 320 are shown in FIG. 6B.

As described above, the user must first select the transmitter type, at block 322. At block 324, the microcontroller 12 stores the user input parameters (transmitter type and code) in non-volatile memory. The microcontroller 12 also stores transmitter type and the specific hardware/RF configuration, setup and frequency settings. These stored values are used when the user operates the transmitter to operate a receiver. After programming, the transmitter powers down at block 226.

Figure 6C:
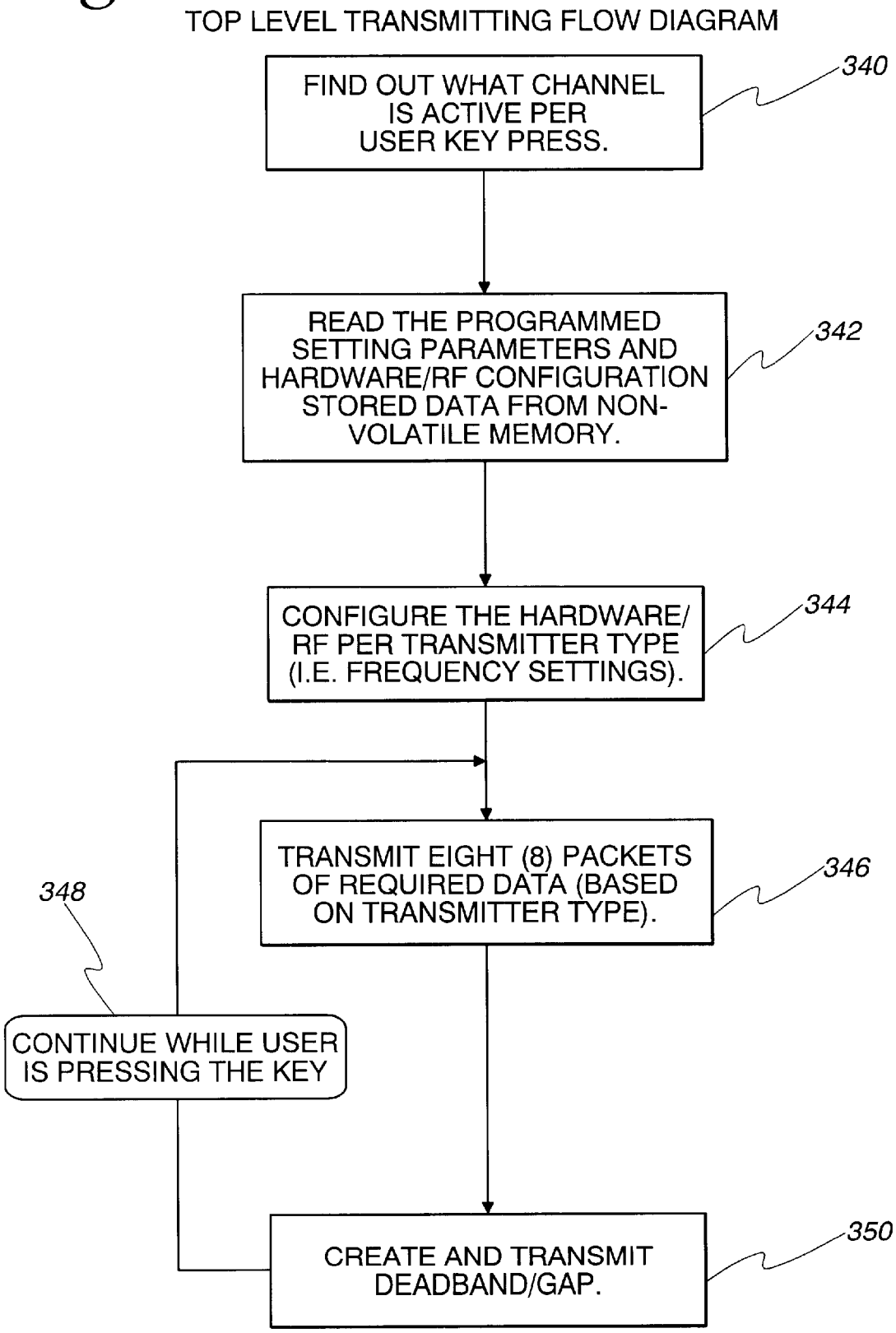

Referring to FIG. 6C and block 340, when transmitting the microcontroller 12 determines which channel is active based on which switch was depressed by the user (S1, S2 or S3). At block 342, the microcontroller 12 reads from non-volatile memory the stored programmed setting parameters and hardware/RF configuration data. At block 344, the microcontroller configures the hardware/RF transmitter type (selecting the frequency in accordance with table 2 and activating the PIN diodes TD4 and D5 accordingly). At block 346 microcontroller 12 transmits eight packets of code data (from pin PB6 to the base of transistor Q1). At block 350, microcontroller 12 creates and transmits a deadband gap. Then microcontroller 12 continues to block 348 where it loops while the user continues to press the selected switch (S1, S2 or S3).

Figure 6D:
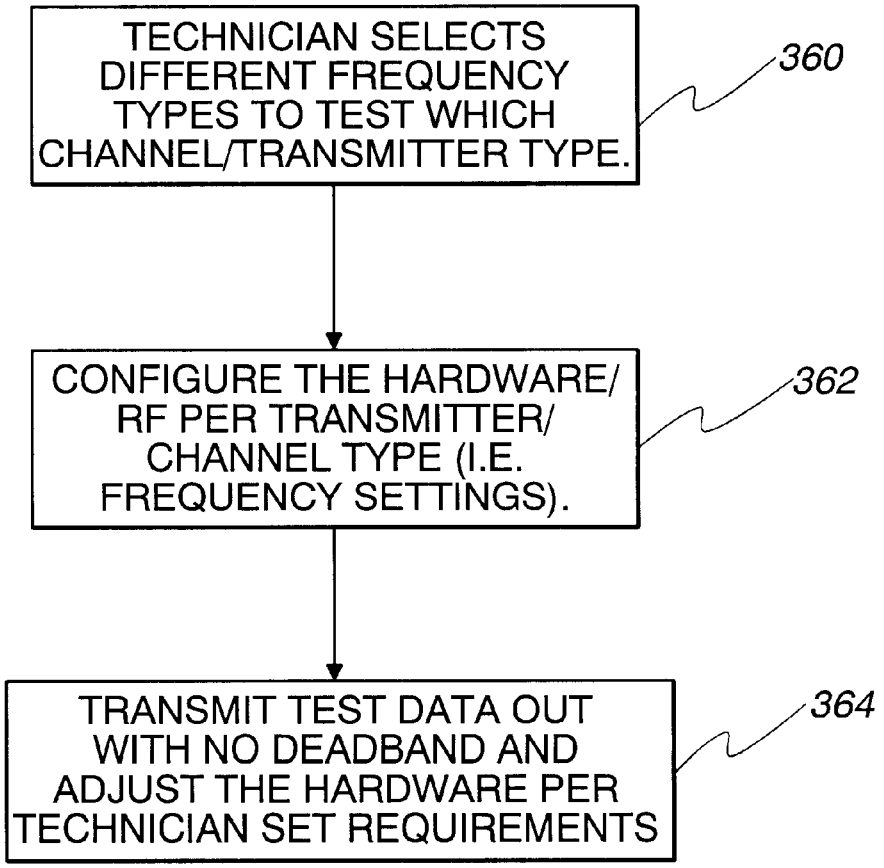

As described above, jumpers J1 and J2 are used by the factory to test the transmitter 10 prior to shipping. After testing the jumpers are cut. Referring to FIG. 6D, at block 360, during the test routine, the microcontroller 12 determines which channel/transmitter type (300 MHz., 310 MHz. or 390 MHz.) is being requested by the technician's input for tuning. At block 362, the microcontroller configures the hardware/RF per the transmitter/channel type. At block 364 the microcontroller transmits stored test code data (provides code data at pin PB6 to the base of transistor Q1), but without a deadband. The technician makes any adjustments to the variable capacitors as needed.

Figure 6E:
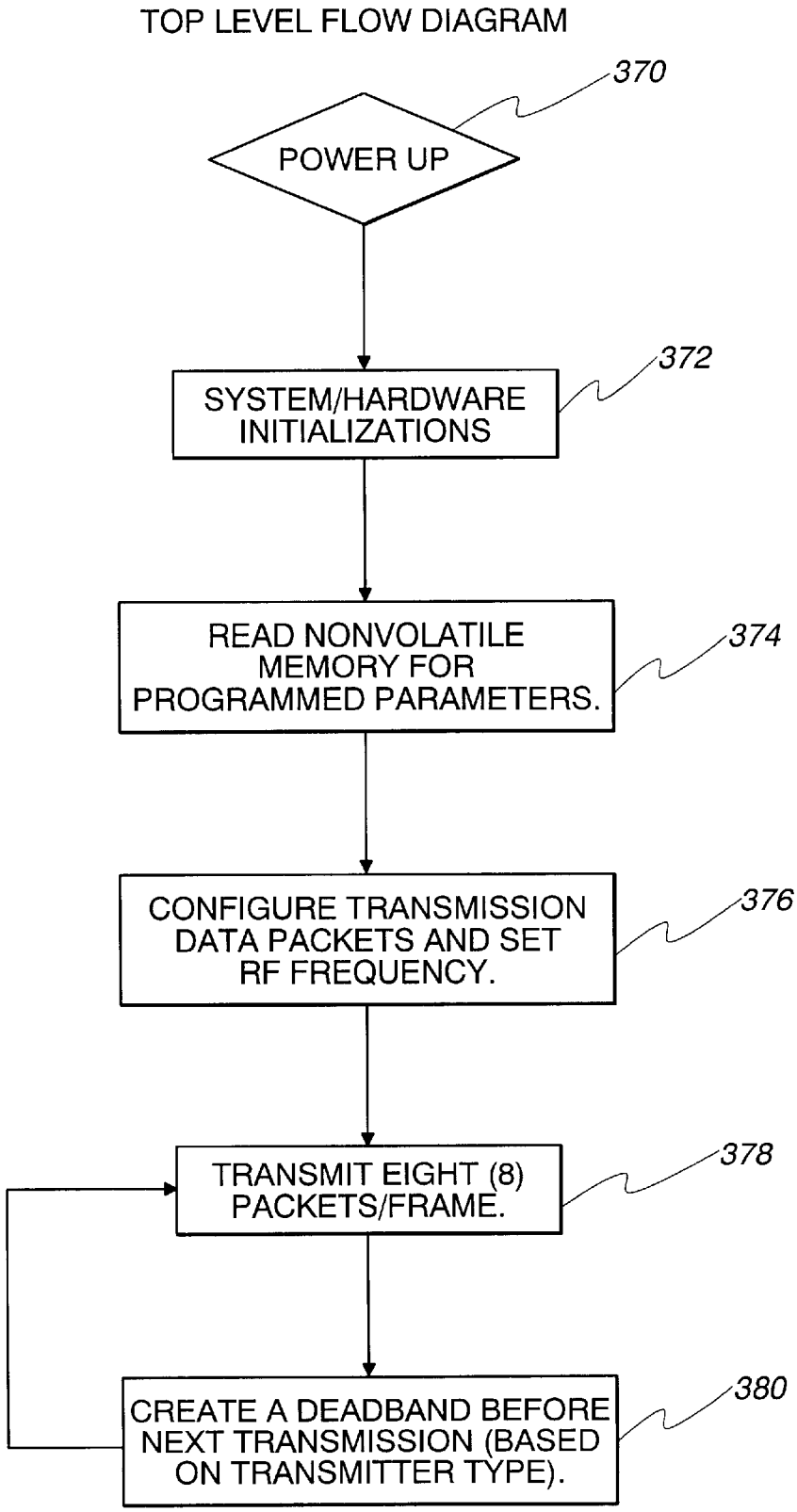

A top level flow chart of transmitter operation is shown in FIG. 6E. The transmitter is powered up at block 370. System/hardware initialization is performed in block 372 (see also FIG. 6A). Non-volatile memory is read for programmed parameters at block 374. Transmission data packets and RF frequency is set in block 376. Data is transmitted eight packets at a time in block 378 followed by a deadband in block 380 and looped until the entire code is transmitted.

While there has been illustrated and described a particular embodiment of the present invention, it will be appreciated that numerous changes and modifications will occur to those skilled in the art, and it is intended in the appended claims to cover all those changes and modifications which followed in the true spirit and scope of the present invention.

What is claimed is:

1. A radio frequency transmitter for actuating a plurality of movable barrier operator receivers, each receiver receiving a particular radio frequency signal having a frequency, modulated according to a particular code, comprising:

a transmitter circuit for transmitting a modulated carrier signal at a plurality of different frequencies according to a plurality of different codes, comprising:

a transmit oscillator, a tuning circuit comprising a plurality of discrete reactive components, and a radiating element having an effectively variable electrical length;

an input device for providing user-selectable input for programming frequency and code;

a digital controller coupled to the input device for storing received user-selectable data identifying a user-selected carrier frequency and a user-selected code and for generating frequency control signals representing the user selected carrier frequency;

a switching circuit coupled to said tuning circuit, said transmit oscillator and said variable radiating element, said switching circuit being responsive to the frequency control signals for changing the effective electrical length of the radiating element and removing selected discrete reactive components from the tuning circuit;

said digital controller coupled to said transmitter circuit for operating the transmitter circuit to cause the transmitter circuit to be modulated with signals generated by the digital controller from said stored user-selected frequency and said stored user-selected code; and said variable radiating element being operable for radio frequency transmission of the signals responsive to the digital controller.

2. The transmitter of claim 1 wherein said input device comprises a plurality of user controlled switches.

3. The transmitter of claim 2, wherein each switch of said plurality of user controlled switches is operable to activate a different movable barrier operator receiver.

4. The transmitter of claim 1 wherein said switching circuit comprises first and second PIN diode switch circuits coupled to said tuning circuit and said radiating element for selectively shorting particular reactive elements in said tuning circuit and for varying the length of said radiating element in response to the frequency control signals from the digital controller.

5. The transmitter of claim 4 wherein said PIN diodes are reverse biased when not selected by the digital controller.

6. The transmitter of claim 5 wherein said input device comprises first, second and third switches and said transmitter circuit is selectively operable at frequencies of 300 MHz, 310 MHz and 390 MHz.

7. The transmitter of claim 3 further comprising a test input coupled to the digital controller, said test input having a first state for associating each switch of the plurality of user controlled switches with different predetermined codes and carrier frequencies and having a second state in which user selected carrier frequencies and codes are associated with the switches.

8. A radio frequency transmitter for actuating a plurality of movable barrier operator receivers, each receiver receiving a particular radio frequency signal of a predetermined frequency, modulated according to a particular code, comprising:

a transmitter circuit for transmitting a signal at a plurality of different frequencies according to a plurality of different codes, comprising:

a transmit oscillator including a tuning circuit comprising a plurality of discrete reactive components, a radiating element having an effectively variable electrical length, and a switching circuit coupled to said tuning circuit, said transmit oscillator and said variable radiating element, said switching circuit being responsive to the frequency control signals for changing the effective electrical length of the radiating element and removing selected discrete reactive components from the tuning circuit;

a digital controller for storing data identifying one or more transmission signal frequencies and one or more codes;

said digital controller coupled to said transmitter circuit for operating the transmitter circuit to cause the transmitter circuit to be modulated with signals generated by the digital controller from said stored user-selected frequency and said stored user-selected code; and said variable radiating element being controlled by the switching circuit for radio frequency transmission of the modulated carrier signals.

9. The transmitter of claim 8 wherein said switching circuit comprises first and second PIN diode switch circuits coupled to said tuning circuit and said radiating element for selectively shorting particular reactive elements in said tuning circuit and for varying the length of said radiating element in response to frequency control from the digital controller.

10. The transmitter of claim 4 wherein said PIN diode switching circuits comprise circuitry for reverse bearing the PIN diodes.

* * * * *